US005402651A

United States Patent [19]

Schulak

[11] Patent Number: 5,402,651

[45] Date of Patent: Apr. 4, 1995

[54] ENERGY EFFICIENT DOMESTIC REFRIGERATION SYSTEM

[76] Inventor: Edward R. Schulak, 567 Aspen, Birmingham, Mich. 48009

[21] Appl. No.: 167,741

[22] Filed: Dec. 15, 1993

Related U.S. Application Data

[63] Continuation-in-part of Ser. No. 995,980, Dec. 23, 1992, Pat. No. 5,291,749.

[51] Int. Cl.[6] ..... F25B 13/00

[52] U.S. Cl. ..... 62/89; 62/183; 62/332; 62/428

[58] Field of Search ..... 62/332, 405, 183, 410, 62/411, 89, 428

[56] References Cited

U.S. PATENT DOCUMENTS

| | | | |
|---|---|---|---|
| 1,769,119 | 7/1930 | Davenport . | |
| 2,234,753 | 3/1941 | Frazer . | |
| 2,362,729 | 11/1944 | Smith . | |
| 2,517,686 | 8/1950 | Larkin | 62/405 |
| 2,579,056 | 12/1951 | Thompson . | |
| 3,017,162 | 1/1962 | Haines et al. | 62/238.5 X |
| 3,123,986 | 3/1964 | Lukas et al. | 62/183 X |
| 3,248,895 | 5/1966 | Mauer | 62/157 |
| 3,370,438 | 2/1968 | Hopkinson | 62/196.4 |
| 3,478,533 | 11/1969 | Kocher et al. | 62/196.4 |
| 3,500,655 | 3/1970 | Lyons | 62/183 |
| 3,785,168 | 1/1974 | Domingorene | 62/455 |
| 3,905,202 | 9/1975 | Taft et al. | 62/196.4 |
| 4,008,579 | 2/1977 | Horvay | 62/452 |
| 4,068,494 | 1/1978 | Kramer | 62/196.4 |
| 4,136,528 | 1/1979 | Vogel et al. | 62/174 |
| 4,220,011 | 9/1980 | Bergman et al. | 62/185 |
| 4,245,481 | 1/1981 | McDermott | 62/411 X |
| 4,365,983 | 12/1982 | Abraham et al. | 62/81 |
| 4,437,317 | 3/1984 | Ibrahim | 62/81 |
| 4,474,022 | 10/1984 | Puskar | 62/96 |
| 4,735,059 | 4/1988 | O'Neal | 62/196.4 |
| 4,815,298 | 3/1989 | Van Steenburgh, Jr. | 62/196.4 |
| 5,070,705 | 12/1991 | Goodson et al. | 62/197 |

FOREIGN PATENT DOCUMENTS

| | | |
|---|---|---|
| 2189693 | 6/1973 | France . |
| 1779653 | 1/1978 | Germany . |
| 4114915 | 11/1992 | Germany . |

*Primary Examiner*—William E. Wayner
*Attorney, Agent, or Firm*—Harness, Dickey & Pierce

[57] ABSTRACT

An energy transfer system for a household refrigeration appliance. The energy transfer system includes a venting system within the refrigeration appliance, and a set of conduits for enabling the transfer of outside air into, through and out of the venting system. The system moves cooling air around the storage compartment and compressor. In one form of the present invention, the system may also include a thermostatically actuated valve for enabling outside air into, through and out of the compartment in response to a predetermined temperature.

10 Claims, 4 Drawing Sheets

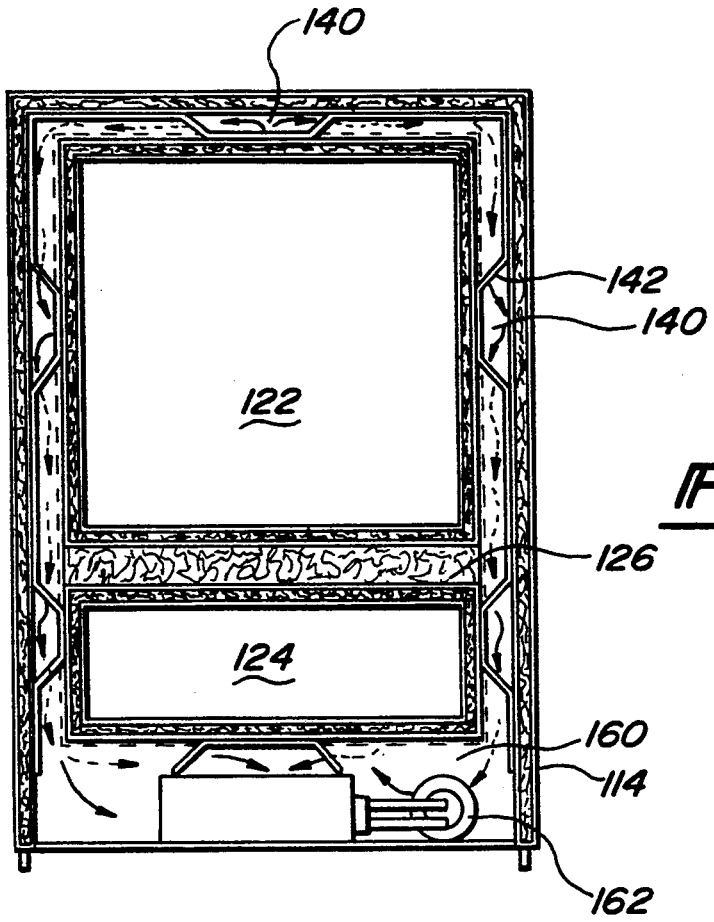
Fig-7
Fig-8
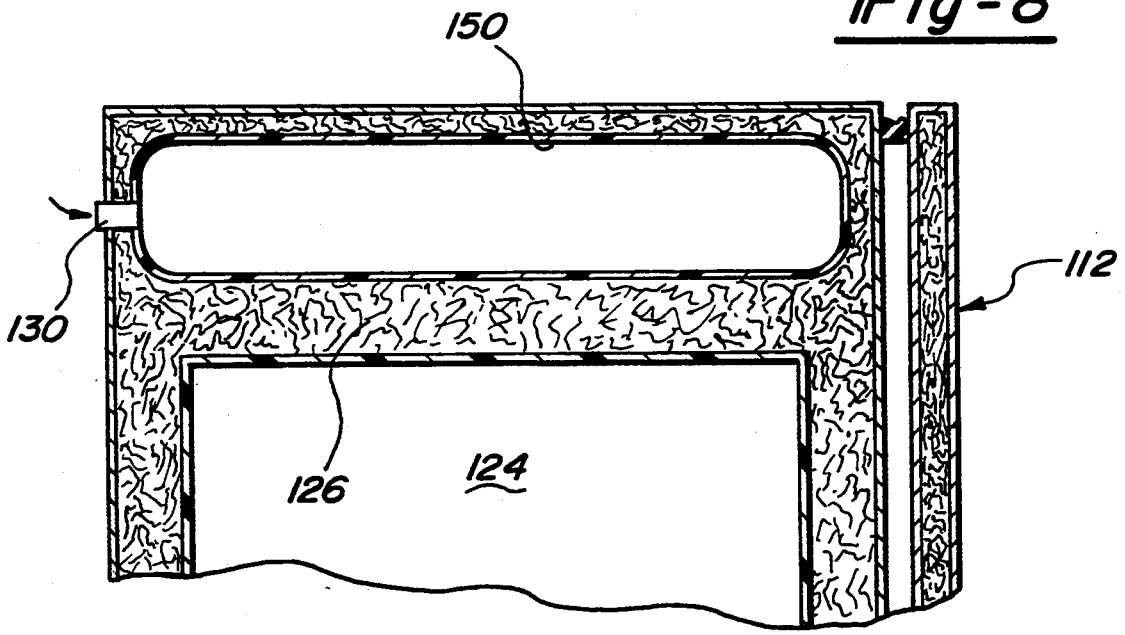

ENERGY EFFICIENT DOMESTIC REFRIGERATION SYSTEM

RELATED APPLICATIONS

This application is a continuation-in-part of Ser. No. 995,980, now U.S. Pat. No. 5,291,749, filed Dec. 23, 1992, with the same title, the specification and drawings of which are herein expressly incorporated by reference.

BACKGROUND OF THE INVENTION

The present invention generally relates to domestic refrigerators and freezers. More particularly, the present invention relates to a system and method for utilizing cool outdoor ambient temperature levels to reduce the energy required to operate a domestic refrigerator or freezer system.

Virtually every home and apartment in this country has at least one refrigerator for storing perishable food products. Additionally, many households also have a freezer for storing food products over extended periods of time. As a consequence of such widespread usage, these domestic appliances consume a substantial part of the electrical energy which is generated by the nation's utility companies. In this regard, it should be noted that refrigerators are considered to be a relatively inefficient appliance. Indeed, it has recently been reported that aside from electric heaters, refrigerators rank as the next most inefficient appliances in the home. Since even the newest refrigerators consume approximately 700 kwh of electricity per year, it should be understood that a substantial need still exists to increase the energy efficiency of domestic refrigeration appliances.

Accordingly, it is a principal objective of the present invention to provide a system and method which reduces the energy required to operate domestic refrigerator and freezer systems.

It is another objective of the present invention to provide an energy efficient domestic refrigeration system which minimizes the heat generated inside a home when the outdoor ambient temperature exceeds a desired indoor temperature.

It is an additional objective Of the present invention to provide a domestic refrigeration system which potentially reduces the quantity of refrigerant needed in the system.

SUMMARY OF THE INVENTION

To achieve the foregoing objectives, the present invention provides an energy transfer system for a household refrigeration appliance. The energy transfer system includes a venting system within the refrigerator housing, and a set of conduits for enabling the transfer of outside air into, through and out of the venting system. In one form of the present invention, the system may also include a thermostatically actuated valve for enabling outside air into, through and out of the venting system in response to a predetermined temperature.

The set of conduits preferably includes a first conduit for enabling the transfer of outside air to the venting system, and a second conduit for enabling the transfer of air from the venting system to the outside environment. Each of these conduits are disposed such that they extend through an external wall of said household. To facilitate the convection flow of air, the outlet of one conduit is connected to the compartment at a location which is lower than an inlet connection of the other conduit.

Additional features and advantages of the present invention will become more fully apparent from a reading of the detailed description of the preferred embodiment and the accompanying drawings in which:

BRIEF DESCRIPTION OF THE DRAWINGS

FIG. 7 is a cross-sectional view of FIG. 5 along line 7—7 thereof.

FIG. 8 is a partial cross-sectional view of an alternative embodiment of the present invention.

DETAILED DESCRIPTION OF THE PREFERRED EMBODIMENTS

Figure 1:
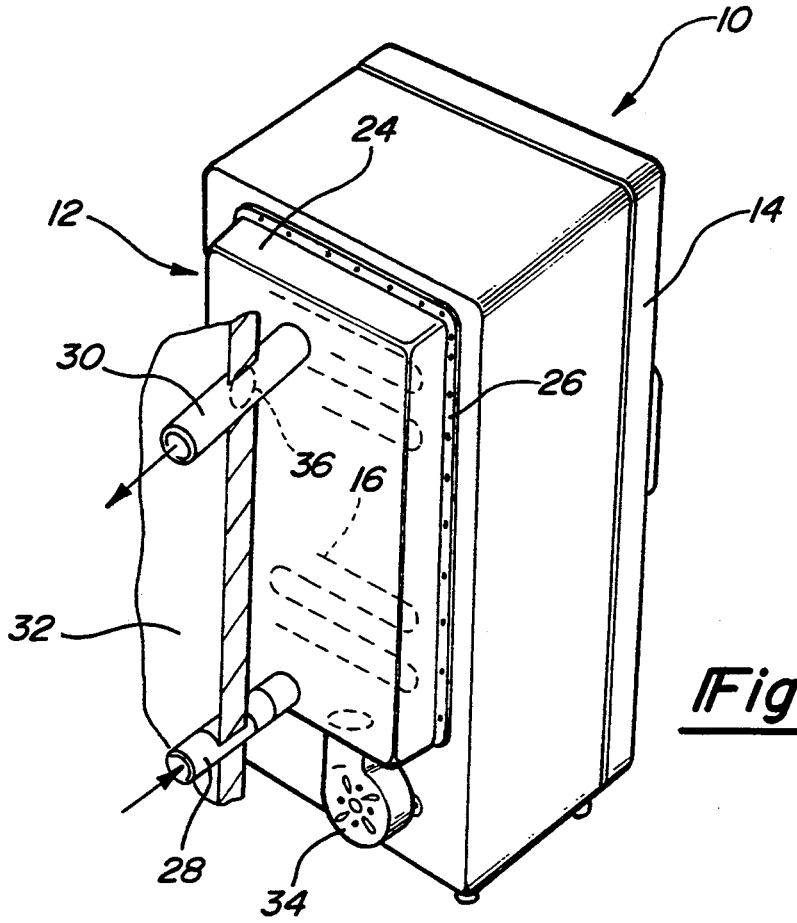
FIG. 1 is a perspective view of a household refrigeration appliance in accordance with the present invention.

Referring to FIG. 1, a perspective view of a household refrigeration appliance 10 in accordance with the present invention is shown. More specifically, the household refrigeration appliance depicted in FIG. 1 is a domestic refrigerator which has been retro-fitted with the energy transfer system 12 in accordance with the present invention. However, it should be understood that the principals of the present inventions are equally applicable to a domestic refrigerator which has been constructed at the originating factory to include a built-in energy transfer system. Additionally, it should be appreciated that the present invention is directed at household refrigeration appliances, such as self-contained refrigerators and freezers, that are specifically adapted for use in a home environment. In this regard, it should be understood that a completely different set of constraints and design criteria may be employed with commercial refrigeration equipment, which have a compressor and refrigerator cabinet in separate locations.

Figure 3:
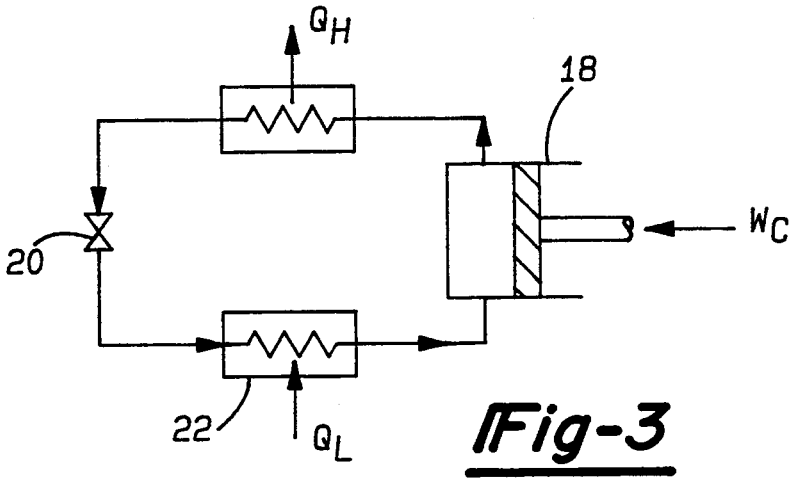
FIG. 3 is a schematic representation of a refrigeration system.

As shown in FIG. 1, the refrigerator 10 generally includes at least one door 14 across its front and a serpentine tube condenser 16 mounted across its back and bottom. As well known in the field, the condenser 16 is connected to the discharge end of a pump to compress a refrigerant fluid, such as freon, from a gaseous phase to a liquid phase. This process creates heat which must be removed in order for the refrigeration cycle to work. In this regard, FIG. 3 shows a schematic diagram of a conventional refrigeration cycle, with the pump indicated by reference numeral 18. An expansion valve 20 is used to permit the compressed refrigerant to expand in an evaporator coil 22, which is disposed within the interior of the refrigerator 10. This process of expansion operates to remove heat from the interior of the refrigerator 10.

With this household refrigerator arrangement, the heat produced at the condenser 16 is simply released into the area of the home which surrounds the refrigerator. However, in accordance with the present invention, a compartment 24 is used to enclose the condenser 16. As shown in FIG. 1, the compartment 24 may be comprised of a five-sided molded fiberglass shell which is mounted to the exterior side of the refrigerator 10 where the condenser 16 is located. In this regard, the compartment 24 includes a flange 26 which extends around its periphery in order to able the compartment to be secured to the refrigerator 10 over the condenser 16, such as with a plurality of spaced screws. However, it should be understood that the compartment may be comprised of other suitable materials and may take other suitable shapes in the appropriate application. For example, with a factory built-in energy transfer system, the compartment 24 may be formed integrally with a side of the refrigerator 10, such that the consumer need not discern that the compartment is included as part of the refrigerator body. Additionally, the compartment 24 may be constructed such that it includes an insulative layer in order to more fully control the transfer of heat from the condenser 16.

Figure 2:
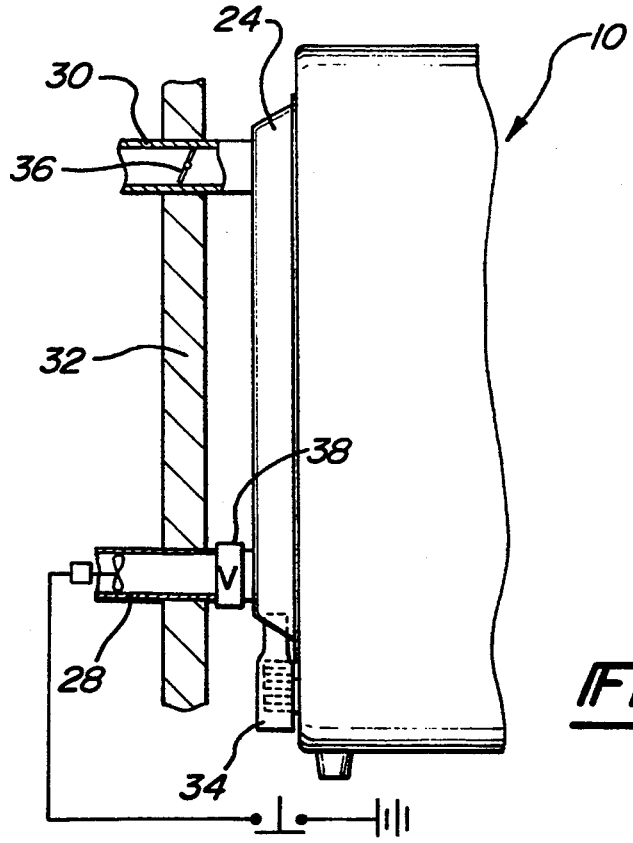
FIG. 2 is a side elevation view of the refrigerator shown in FIG. 1.

The energy transfer system 12 also includes one or more passageways for enabling the transfer of heat out of the compartment 24 and for selectively utilizing outside air in this process. Thus, for example, as shown in FIGS. 1 and 2, the energy transfer system 12 includes a first conduit 28 which enables cool air from outside of the home to enter the compartment 24, and a second conduit 30 which enables air from inside the compartment to be released outside of the home. In this regard, both of these figures show an exterior wall 32 of the household wall, and the conduits 28 and 30 are constructed such that they are able to extend through this exterior wall. The conduits 28 and 30 may be made of any suitable material which is appropriate for this purpose (e.g., sheet metal or flexible insulated duct), and the conduits may be connected to the compartment in a variety of ways.

It should also be noted that the first conduit 28 is connected to the compartment 24 at a location which is lower than that where the second conduit 30 is connected to the compartment. This arrangement is used to facilitate outside air from through the first conduit 28 into the compartment, through the compartment and out of the second conduit 30 by heat convection. While the conduits 28, 30 are shown to be relatively straight pipes or tubes, it should be understood that other suitable shapes may be employed, depending upon such considerations as the available space and the distance between the refrigerator 10 and the exterior wall 32.

FIGS. 1 and 2 also show the provision of a fan 34, which may be used to force the flow of outside air into, through and out of the compartment 24. While the fan 34 is shown to be connected to the compartment 24 in a way which is separate than the connection of the conduits 28, 30 to the compartment, it is preferred that the fan be connected in-line with the first conduit 28, either within the conduit or adjacent to its outlet into the compartment. Additionally, it is preferred that the fan 34 be a thermostatically actuated fan, so that the its use may be carefully controlled to achieve the most energy efficient benefit.

Additionally, as shown in FIGS. 1 and 2, the energy transfer system 12 also includes a movable barrier or wall in one or both of the conduits 28, 30 to control the flow of air through the compartment 24. In one form of the present invention, this movable barrier is comprised of a butterfly valve 36 which may be used to prevent or enable the flow of outside air into the compartment via a butterfly valve disposed in one or both of the conduits 28, 30. For example, in the case of butterfly valve 36 disposed in the second conduit 30, the flow of outside air through the first conduit 28 could provide sufficient force to open the butterfly valve, and thereby permit the escape of air from the compartment 24 through the Second conduit.

From the above, it should be understood that the energy transfer system 12 conveys energy in the form of cool outside air to the condenser 16, in order to reduce the energy consumption of the refrigeration process. In other words, the present invention transfers available energy from the environment to the refrigeration cycle components, instead of having to transfer some of these refrigeration cycle components outside to the environmental energy source. The introduction of available energy to the refrigeration cycle reduces the energy required from the cycle, and consequently increases the overall energy efficiency of the refrigerator 10. This increase in energy efficiency would also enable the use of smaller, more efficient refrigeration components and reduce the amount of refrigerant required for a new refrigerator unit.

Figure 4:
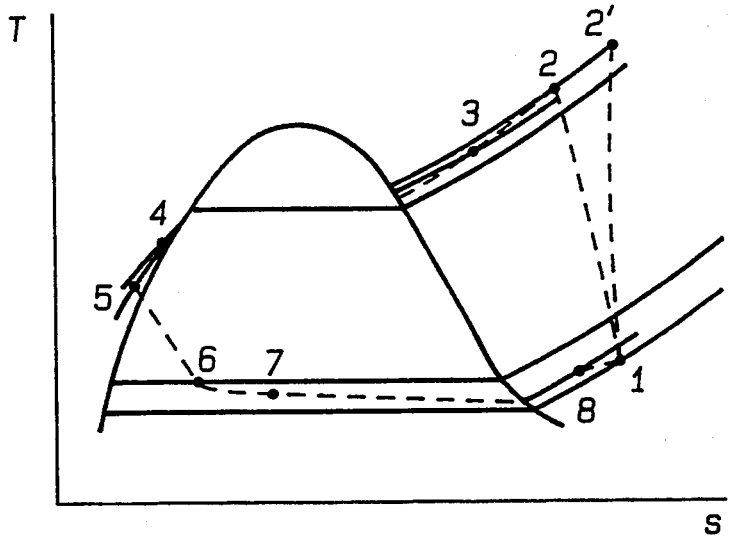
FIG. 4 is a graph of the vapor-compression refrigeration cycle for the refrigeration system of FIG. 3.

The following analysis may be used to demonstrate the energy efficiency improvement by examining the increase in the refrigerator enthalpy "h". This analysis is set forth below in connection with the reference points shown in FIGS. 3 and 4.

Assume 1: In the evaporator the heat absorbed per unit mass=the change in enthalpy of the refrigerant.

Assume 2: At point 7 the refrigerator is a saturated liquid.

Assume 3: At point 8 the refrigerator is a saturated gas.

Assume 4: The refrigerator is freon 12.

Assume 5: Typically the temperature around the expansion valve is 40° C. and the temperature existing at the evaporator is −20° C.

Following all the assumptions the enthalpys are below:

$h_5$ at 40° C.=74.527 KJ/KG $h_5$ at 10° C.=45.337 KJ/KG $h_8$ at −20° C. 184.619 KJ/KG $P_8$ is 150 KPa $h_8 - h_5$ (40° C.) 110.092=$X_1$ $h_8 - h_5$ (10° C.) 139.282=$X_2$

Increase in heat per unit mass absorbed at a percentage $$Y = \frac{X_2 - X_1}{X_2} = 20.96\% \text{ increase.}$$

In other words, assuming that the outside air temperature is low enough such that the temperature at point 8 can be brought down to 10° C. from a level of 40° C., then a 20.96% increase in heat per unit mass absorbed may be achieved.

Thus, in accordance with the present invention, the fan 34 may be actuated when the outside air temperature drops to a predetermined threshold level (e.g., 37° C.), as the energy efficiency achieved will be greater than the energy consumed by the fan. Alternatively, it should be appreciated that the refrigerator 10 may already include a fan which may be used to divert some air flow into the compartment 24 from the outside. The energy transfer system 12 may also include a thermostatically actuated valve, such as the valve which would enable ambient air from inside the household (e.g., 20° C.) to enter the 9 compartment 24 when the outside air temperature is above a particular threshold level (e.g., 37° C.). In this way, the compartment 24 will always be provided with a sufficient supply of air flow to cool the condenser 16.

Figure 5:
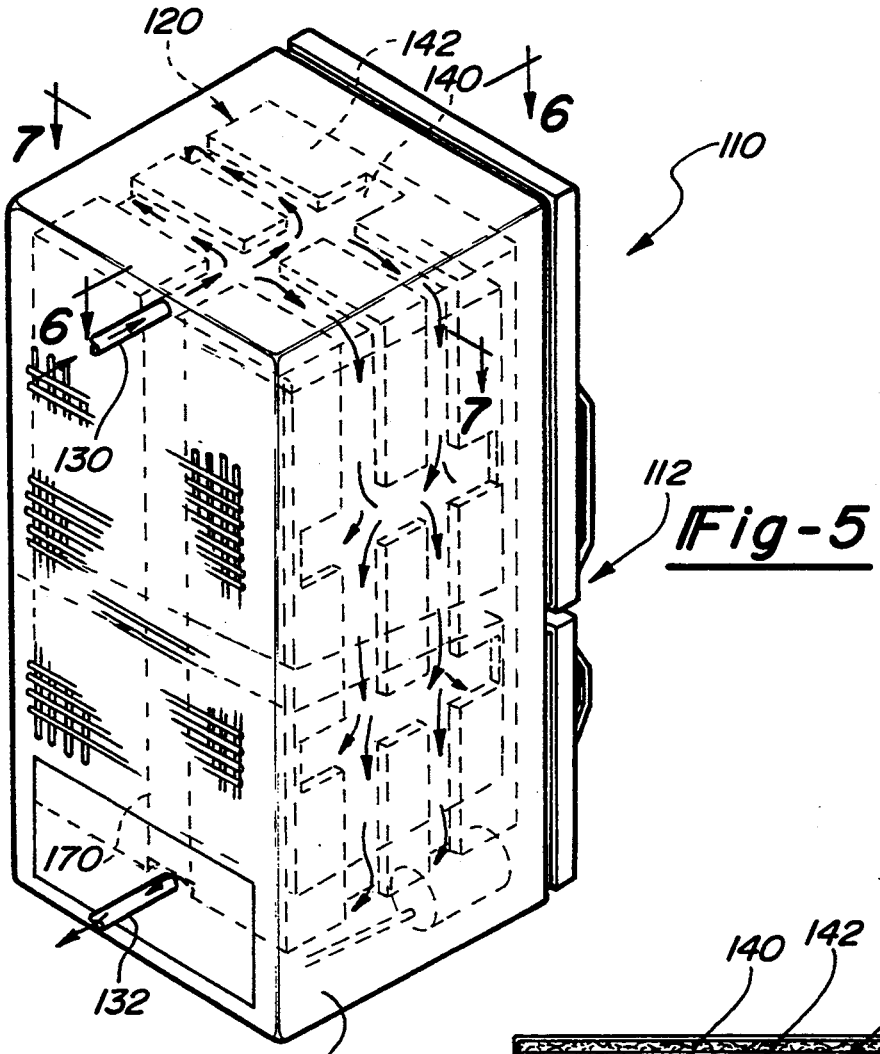
FIG. 5 is a perspective view of a refrigeration appliance in accordance with the present invention.

Turning to FIGS. 5 through 8, additional embodiments of the present invention will be described. FIG. 5 illustrates a refrigerator 110 having a split door 112 and a housing 114. The housing 114 surrounds the refrigeration compartment 116 which includes freezer 122 and cold storage 124 compartments. Also illustrated in phantom is a venting system 120.

Figure 6:
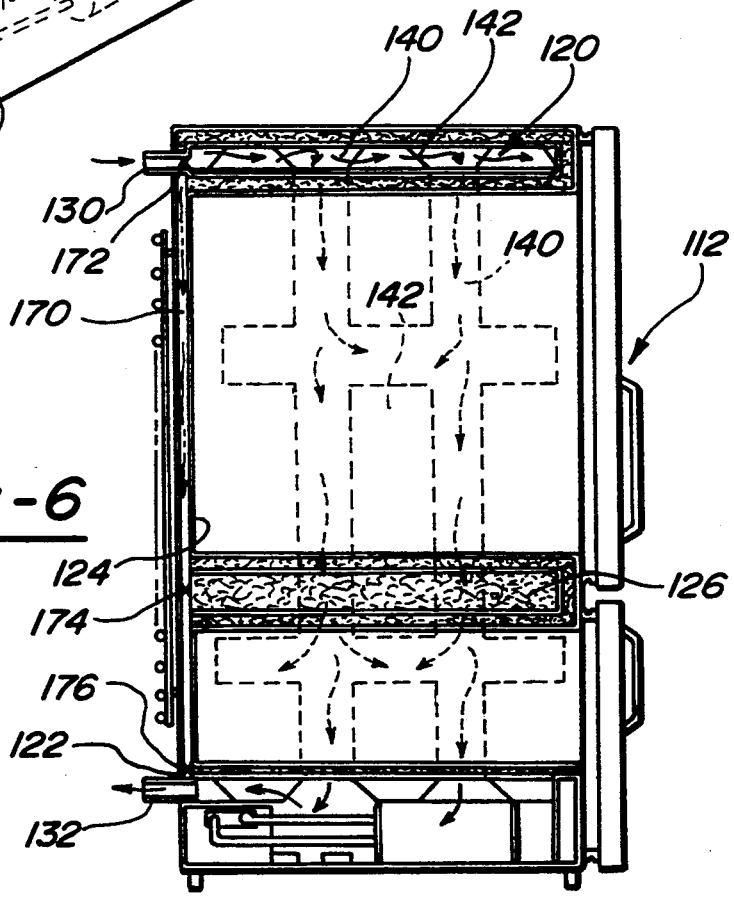
FIG. 6 is a cross-sectional view of FIG. 5 along line 6—6 thereof.
Figure 5:
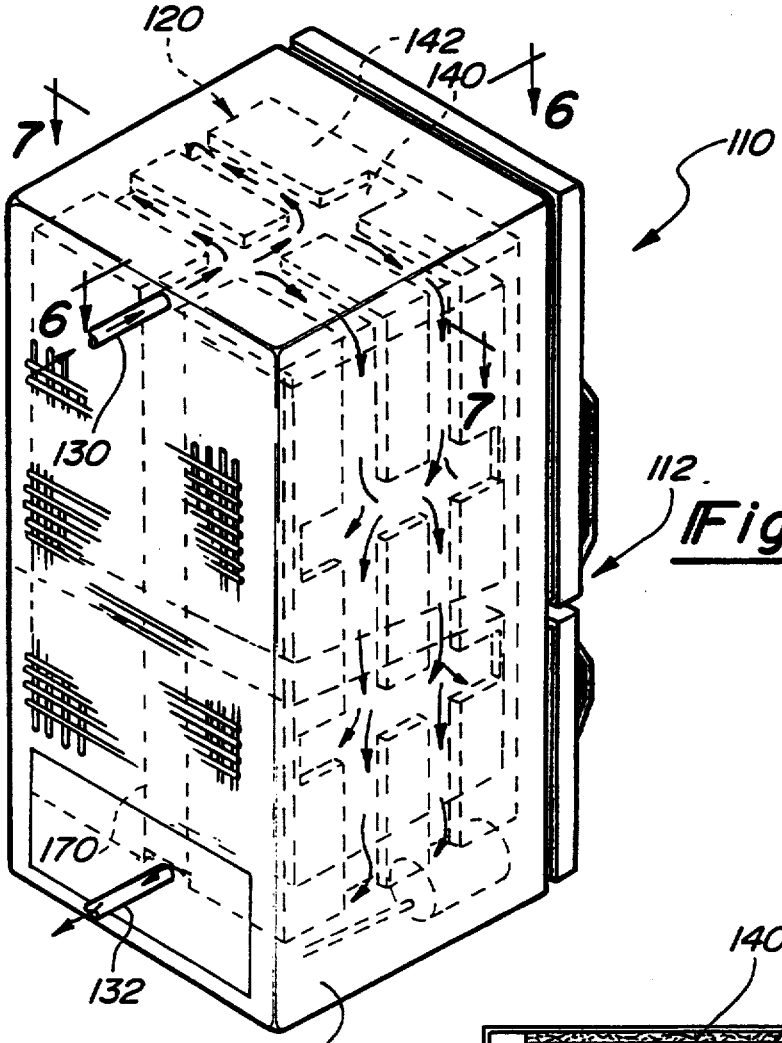
Figure 6:
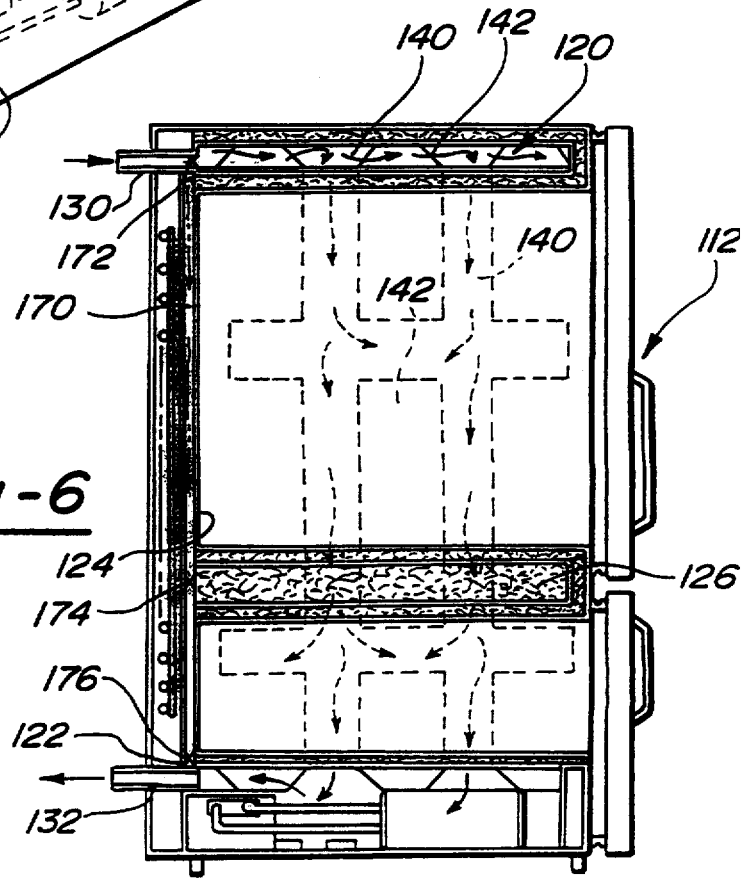

As seen in FIGS. 6 and 7, the freezer 122 and cold storage 124 compartments are surrounded by insulation 126 to maintain a predetermined cold temperature in the compartments. The venting system 120, as illustrated in FIGS. 5 through 7, may surround the compartments 122, 124 or it may be strategically positioned at the top, sides, or bottom of the refrigerator housing. The venting system 120 may take various forms, however, it may be as simple as a gap between the insulation and housing enabling circulation of cold air from the inlet 130 around the compartments within the housing and exiting outlet 132. Various types of spacers or the like may be utilized to form the gap between the insulation and housing.

As illustrated, cold air enters the inlet 130, and is diffused throughout the top of the refrigerator. The air moves along the sides around the storage 122 and freezer 124 compartments. The cool air then moves around the compressor area 136 and the bottom of the compartments and exits out of the refrigerator. Various types of films or the like may be utilized to cut down on dust and condensation, if present, between the housing and the insulation. As the air circulates within the refrigerator housing 114 and is directed toward the inlet, the hot air generated around the compressor is also collected and exited from the refrigerator. Thus, by providing cool air circulating around the storage and freezer compartments, it requires less work from the compressor, since the hot air surrounding the compartments has been removed. Thus, this increases the efficiency and decreases the amount of work performed by the compressor which, in turn, reduces the overall electric consumption of the refrigerator.

In FIGS. 5 through 7, the air flow is shown entering the refrigerator housing through the inlet 130. As the air enters the inlet 130, it is deflected by a number of channels 140 separated by vanes 142. As the air deflects around the vanes into the channels, it is directed along the sides of the refrigerator, as seen in FIGS. 5 through 7. Upon flow along the sides of the compartment, the air is directed towards the compressor area 160. The air circulates around the compressor 162 and then exits through the outlet 132. A number of different vane and channel designs may be utilized to move the air throughout the refrigerator. Thus, the specific numbers of vanes and channels for movement of the air may be modified as desired to optimize the cooling of the area. Also, an additional conduit 170 and valving may be coupled with the inlet 130. The conduit 170 includes valves 172, 174, 176 which open and close to direct air flow into the refrigerator housing. In cases where the ambient temperature is above a desired temperature where it will not cool the storage compartments but cool the compression area, the valves 172, 174, 176 can be adjusted to direct the air flow directly into the desired area.

FIG. 8 illustrates an additional embodiment of the present invention. In FIG. 8, the inlet 130 empties into a bag like membrane 150 positioned in the gap between the housing and the insulation. The bag membrane 150 enables the air to enter into the membrane and then pass along the top and sides of the refrigerator and then exit in the compressor area. The bag membrane provides a dust barrier between the housing and the insulation enabling the air to move alongside the storage and freezer compartments without creating an abnormal amount of dust. Also, the membrane would collect condensation, if any, and direct it out of the bag. Other types of barriers or venting systems may be utilized to provide the necessary cooling between the compartments and the housing.

Preferably, the compressor cooling fan would be utilized to draw the air into the housing. However, an additional fan may be used.

Also, as mentioned above, a thermostatically actuated valve, fan or the like may be positioned into the conduits for enabling passage of air. Also, conduits would be adaptable to receive air from the ambient surroundings of the refrigerator.

The present invention has been described in an illustrative manner. In this regard, it is evident that those skilled in the art once given the benefit of the foregoing disclosure, may now make modifications to the specific embodiments described herein without departing from the spirit of the present invention. Such modifications are to be considered within the scope of the present invention which is limited solely by the scope and spirit of the appended claims.

What is claimed is:

1. A refrigeration or freezer appliance comprising:

a housing surrounding at least one cooling storage compartment;

refrigeration means including a compressor or condenser for cooling space within said at least one cooling storage compartment; and cooling means for adding and removing air between said housing and at least one cooling storage compartment, said cooling means coupled between said housing and at least one cooling storage compartment for cooling between said housing and said cooling storage compartment, and said cooling means coupled with an air source and said air passing over said compressor or condenser.

2. The refrigeration appliance according to claim 1, wherein said cooling means further comprises an inlet and outlet for enabling ingress and egress of air and a venting system positioned within said housing for circulating the air through and out of said housing.

3. The refrigeration appliance according to claim 2, wherein a gap is formed between said housing and at least one storage compartment.

4. The refrigeration appliance according to claim 2, wherein said venting system includes one or more air deflecting members.

5. The refrigeration appliance according to claim 2, wherein said inlet and outlet are coupled to the outside environment.

6. The refrigeration appliance according to claim 1, wherein said refrigeration means includes a fan means and said fan means drives air through said cooling means.

7. The refrigeration appliance according to claim 6, wherein a valve means provides air flow for said cooling means and said valve means opening and closing is thermostatically controlled.

8. A method of reducing the energy required to operate a refrigeration or freezer appliance, comprising the steps of:

providing a refrigerator with a housing and at least one storage compartment and a refrigeration means for cooling within said storage compartment, said refrigeration means including a compressor or condenser;

coupling a cooling means between said housing and at least one storage compartment for cooling between said housing and said at least one storage compartment; and causing outside air to flow into, through and out of said cooling means and passing over said compressor or condenser when the outside temperature reaches a predetermined threshold.

9. The method according to claim 8, further comprising enabling the inside air to flow into, through and out of said cooling means when the outside temperature has not reached said predetermined threshold.

10. The method according to claim 8, wherein said step of causing outside air to flow includes the step of forcing outside air to flow into, through and out of said housing.

* * * * *

UNITED STATES PATENT AND TRADEMARK OFFICE

CERTIFICATE OF CORRECTION

PATENT NO. : 5,402,651

DATED : April 4, 1995

INVENTOR(S) : Schulak

It is certified that error appears in the above-indentified patent and that said Letters Patent is hereby corrected as shown below:

In The Drawings, delete Sheet 3 showing Figures 5 and 6 and substitute therefor the attached drawing sheet, Page 2 of 2, showing Figures 5 and 6.

Signed and Sealed this

Twenty-first Day of January, 1997

*Attest:*

*Attesting Officer*

BRUCE LEHMAN

*Commissioner of Patents and Trademarks*